US012202666B2

(12) United States Patent
Van Schie et al.

(10) Patent No.: US 12,202,666 B2
(45) Date of Patent: Jan. 21, 2025

(54) PACKAGING BOX CONFIGURATION FOR PROTECTIVELY PACKAGING POTTED PLANTS BY MEANS OF A BASIC BOX IN A VERTICAL OR HORIZONTAL POSITION OF THIS BASIC BOX

(71) Applicants: J. VAN GEEST HOLDING B.V., 's-Gravenzande (NL); PAXPRING B.V., Weesp (NL); S.F. VAN SCHIE HOLDING B.V., 's-Gravenzande (NL)

(72) Inventors: Steef Van Schie, 's-Gravenzande (NL); Jan Van Geest, 's-Gravenzande (NL); Jerom Van Beuzekom, Weesp (NL)

(73) Assignee: CLICK-PAX PATENTS B.V. (NL)

( * ) Notice: Subject to any disclaimer, the term of this patent is extended or adjusted under 35 U.S.C. 154(b) by 0 days.

(21) Appl. No.: 18/029,524

(22) PCT Filed: Sep. 29, 2021

(86) PCT No.: PCT/NL2021/050588
§ 371 (c)(1),
(2) Date: Mar. 30, 2023

(87) PCT Pub. No.: WO2022/071796
PCT Pub. Date: Apr. 7, 2022

(65) Prior Publication Data

US 2023/0356922 A1 Nov. 9, 2023

(30) Foreign Application Priority Data

Sep. 30, 2020 (NL) ..... 1043799

(51) Int. Cl.
*B65D 85/52* (2006.01)
*B65D 5/50* (2006.01)

(52) U.S. Cl.
CPC ..... *B65D 85/52* (2013.01); *B65D 5/5038* (2013.01)

(58) Field of Classification Search
CPC ..... B65D 5/50; B65D 5/5038; B65D 85/52
(Continued)

(56) References Cited

U.S. PATENT DOCUMENTS 1,669,617 A 5/1928 Kennedy
5,379,549 A * 1/1995 Carcich ..... B65D 5/5028 47/84
5,710,641 A * 1/1998 Lowry ..... B65D 85/505 358/479

FOREIGN PATENT DOCUMENTS

JP H-09290837 A 11/1997
JP 2004051141 A 2/2004

OTHER PUBLICATIONS

International Search Report (ISR) for PCT/NL2021/050588 mailed Jan. 4, 2022 (3 pages).

(Continued)

*Primary Examiner* — Bryon P Gehman
(74) *Attorney, Agent, or Firm* — Shumaker, Loop & Kendrick, LLP; Patrick B. Horne

(57) ABSTRACT

Packaging box configuration for packaging potted plants, comprising a basic box having a fixed wall, four side walls and an open side which can be closed off by a lid or door. The basic box is configured to be able to be used either vertically ("wardrobe mode"), wherein one of the side walls then serves as a bottom wall and the fixed wall as a rear wall, or horizontally ("chest mode"), wherein the fixed wall then serves as a bottom wall. To this end, the basic box comprises two mutually opposite side walls which are provided with folding lips which can be pushed in. The basic box can be used vertically using a first bearing platform and support platform which engage with the folding lips of the basic box.

(Continued)

The basic box can also be used horizontally using a second bearing platform and support platform.

6 Claims, 3 Drawing Sheets

(58) Field of Classification Search
USPC ..... 206/423; 47/84
See application file for complete search history.

(56) References Cited

OTHER PUBLICATIONS

Written Opinion (WO) for Cited in ISR for PCT/NL2021/050588 mailed Jan. 4, 2022 (6 pages).

* cited by examiner

PACKAGING BOX CONFIGURATION FOR PROTECTIVELY PACKAGING POTTED PLANTS BY MEANS OF A BASIC BOX IN A VERTICAL OR HORIZONTAL POSITION OF THIS BASIC BOX

TECHNICAL FIELD AND BACKGROUND

The invention relates to a packaging box configuration, intended and configured for protectively packaging one or more potted plants, comprising a basic box made of sheet material, preferably cardboard, having a fixed bottom/rear wall, referred to below as fixed wall, four side walls and an open top/front side which is closable by a lid or door, referred to below as open side.

SUMMARY

The present invention aims to provide such a packaging configuration in which the same basic box can be used in either an upright, vertical position ("wardrobe mode") for packaging, for example, one relatively large potted plant, or in a horizontal position ("chest mode") for packaging, for example, several relatively small potted plants. In the "wardrobe mode", use is then made, in addition to the basic box, of a first bearing platform (having a relatively small load-bearing surface) and preferably a first support platform in order to reliably secure the potted plant and/or the pot in which it is contained, whereas, when the basic box is used in "chest mode", a second bearing platform (having a relatively large load-bearing surface) is used, in which several (relatively small) potted plants can be placed (in pot cavities intended for the purpose).

According to the invention, a packaging box configuration is provided to this end which, as has been indicated above, is intended and configured for protectively packaging one or more potted plants, comprising a basic box made of sheet material, preferably cardboard, having a fixed bottom/rear wall, referred to below as a fixed wall, four side walls and an open top/front side which is closable by a lid or door, referred to below as open side, which basic box is intended and configured to be able to be used either vertically ("wardrobe mode"), wherein one of the side walls then serves as a bottom wall (bottom) and the fixed wall as a rear wall, or horizontally ("chest mode"), wherein the fixed wall then serves as a bottom wall, to which end two mutually opposite side walls of the basic box are each provided with at least one, however preferably at least two, folding lips which can be pushed in from the outside to the inside along a fold line, by means of which fold line the folding lip is connected to the side wall and also remains connected after having been pushed in, which fold line extends parallel to the imaginary intersecting line of the face of this side wall and the face of the fixed wall.

In order to use the basic box vertically ("wardrobe mode") for packaging a potted plant in this position, the packaging box configuration preferably comprises a first bearing platform made of sheet material, preferably cardboard, comprising a carrier leaf provided with at least one pot opening and at least two oppositely positioned side leaves which are configured to be folded down before the first bearing platform is used in combination with the basic box; wherein all this is configured in such a way that the carrier leaf of the first bearing platform extends inside the basic box under the bottom folding lips in the vertical side walls of the basic box, parallel to the side wall which, in this position of the basic box, serves as a bottom wall, after which the pot of the potted plant to be packaged can be placed in the pot opening. In addition, in order to use the packaging box configuration in "wardrobe mode", a first support platform made of sheet material, preferably cardboard, is preferably provided, comprising a support leaf having one or more openings, configured to lock and/or support the one or more plant pots and/or potted plants during use, which support platform comprises at least two oppositely positioned side leaves which are provided with a folding lip and which are configured to be folded down before the first support platform is used in combination with the basic box; wherein all this is configured in such a way that the support leaf of the first support platform extends inside the basic box above the bottom folding lips in the vertical side walls of the basic box, parallel to the side wall which, in this position of the basic box, serves as a bottom wall, while the folding lips in the side leaves are positioned in such a way that, when placing the potted plant in the first bearing platform, the potted plant and/or the pot of this potted plant is embraced by the U-shaped or fork-shaped support leaf while the folding lips in the side leaves of the first support platform are pushed inwards by pushing the folding lips provided in the side walls of the basic box inwards from the outside of the basic box. The first support platform serves to reliably secure the potted plant in the basic box and the first bearing platform.

Preferably, the folding lips in the side leaves of the first support platform are of a double design, because they comprise a first folding lip, the position of the fold line of which, during use of the first support platform in combination with the basic box, corresponds to the position of the fold line of the respective folding lip in the side wall of the basic box and both folding lips fold inwards in the same manner when they are pushed in from the outside, the fold length of which first folding lip is nevertheless shorter than the fold length of the respective folding lip in the side wall of the basic box, wherein at least one of the side leaves (preferably, however, both side leaves) of the first support platform comprises a second folding lip, the fold line of which, during use of the first support platform in combination with the basic box, is situated on the side of, but outside the reach of, the free end of the respective folding lip in the side wall of the basic box, while the position of the free end of the second folding lip is inside the reach of the free end of the respective folding lip in the side wall of the basic box, all this in such a way that when the respective folding lip in the side wall of the basic box is pushed inwards, the free end of this folding lip touches, and then passes, the free end of the respective second folding lip, as a result of which the free end of the folding lip in the side wall of the basic box is blocked by the second folding lip in the side leaf of the first support platform. The double folding lips in the side leaves of the first support platform serve to ensure that the folding lips in the side walls of the basic box cannot rebound after having been pushed in from the outside, but are blocked by the second folding lip ("blocking lip"), as a result of which both the first bearing platform (which extends under the folding lips of the basic box and is blocked by these folding lips in order to move upwards, for example when the unit is being transported) and the first support platform remain fixed in place due to the cooperating folding lips in the side walls of the basic box and those in the side leaves of the first support platform, so that the unit cannot move and so that the plant and the pot also remain secure in place.

In order to use the basic box horizontally ("chest mode") for packaging a potted plant in this position, the packaging box configuration preferably comprises a second bearing platform made of sheet material, preferably cardboard, comprising a carrier leaf provided with one or (preferably) more pot cavities and at least two oppositely positioned side leaves which are configured to be folded down before the second bearing platform is used in combination with the basic box; wherein the respective parts are configured in such a way that the carrier leaf of the second bearing platform extends inside the basic box and its side leaves rest on the fixed wall which serves as a bottom wall.

The packaging box configuration preferably comprises at least one lid or door which is connected to a side of the open side of the basic box so as to be foldable, configured so that the basic box and its contents can be closed off and thus protected after either the first bearing platform, the first support platform and the at least one potted plant, or the second bearing platform, the second support platform and the one or more potted plants have been installed in the basic box as its contents.

BRIEF DESCRIPTION OF THE FIGURES

The invention will now be explained in more detail by means of the following description of the figures, in which.

DETAILED DESCRIPTION

Figure 1:
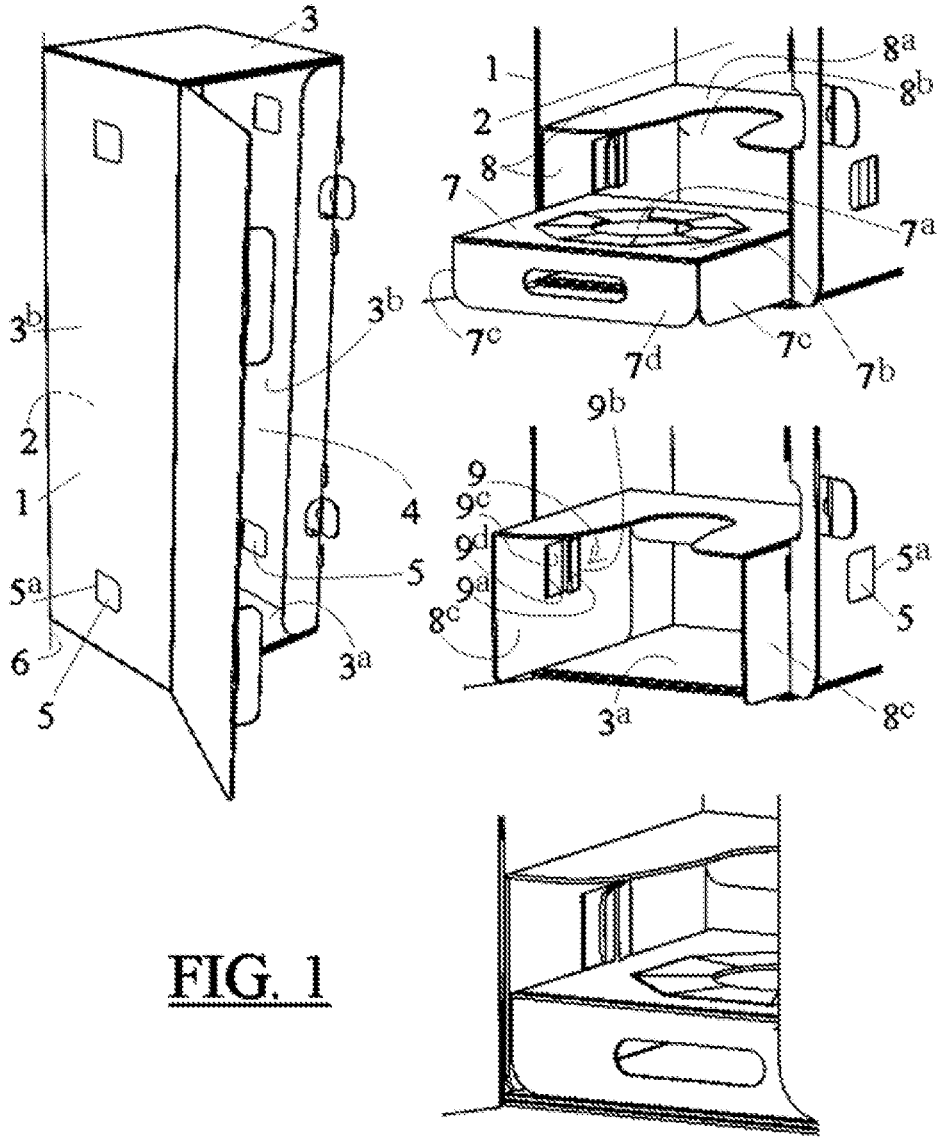
FIG. 1 shows an exemplary embodiment of a packaging box configuration according to the invention, in which the basic box is used in vertical "wardrobe mode"

FIG. 1 shows an exemplary embodiment of a packaging box configuration according to the invention, for protectively packaging one or more potted plants (not shown), comprising a basic box 1 made of sheet material, preferably cardboard, having a fixed bottom/rear wall, referred to below as fixed wall 2, four side walls 3 and an open top/front side which can be closed by a lid or door, referred to below as open side 4, which basic box 1 is intended and configured so that it can be used either vertically (see FIG. 1), in which case one of the side walls 3*a* then serves as a bottom wall and the fixed wall 2 as a rear wall, or so that it can be used horizontally (see FIG. 2), in which case the fixed wall 2 then serves as a bottom wall.

For both uses, the vertical and the horizontal, each of the two mutually opposite side walls 3*b* of the basic box 1 is provided with two folding lips 5 which can be pushed in from the outside to the inside along a fold line 5*a*, via which fold line 5*a* the folding lip is connected to the side wall 3*b* and also remains connected after having been pushed in, which fold line 3*b* extends parallel to the imaginary intersecting line 6 of the face of this side wall 3*b* and the face of the fixed wall 2.

For vertical use of the basic box for packaging a potted plant in that position (see FIG. 1), the packaging box configuration comprises a first bearing platform 7 made of sheet material, preferably cardboard, comprising a carrier leaf 7*b* which is at least provided with one pot opening 7*a*, and at least two oppositely positioned side leaves 7*c* which are configured to be folded down before the first bearing platform 7 is used in combination with the basic box 1. In addition, the first bearing platform 7, in the illustrated embodiment, comprises a front leaf 7*d* which can be folded down and can be used to pull the first bearing platform 7 out of the basic box 1. All this is configured in such a way that the carrier leaf 7*a* of the first bearing platform 7 extends inside the basic box 1 under the bottom folding lips 5 in the vertical side walls 3*b* of the basic box 1 and parallel to the side wall 3*a* which, in that position of the basic box, serves as a bottom wall, following which the pot of the potted plant to be packaged can be placed in the pot opening.

For vertical use of the basic box for packaging a potted plant in that vertical position, the packaging box configuration furthermore comprises a first support platform 8 made of sheet material, preferably cardboard, comprising a support leaf 8*a* having an opening 8*b* which is configured to lock and/or support, and in this way support, the one or more plant pots and/or potted plants during use, while the first support platform 8 furthermore comprises at least two oppositely positioned side leaves 8*c* which are provided with a folding lip 9 and which are configured to be folded down before the first support platform 8 is used in combination with the basic box 1. All this is configured in such a way that the support leaf 8*a* of the first support platform 8 extends inside the basic box 1 above the bottom folding lips 5 in the vertical side walls 3*b* of the basic box 1 and parallel to the side wall 3*a* which, in that position of the basic box 1, serves as a bottom wall, while the folding lips 9 in the side leaves 8*c* are positioned in such a manner that, when placing the potted plant in the first bearing platform, the potted plant and/or the pot of that potted plant is embraced by the U-shaped or fork-shaped support leaf 8*a* and is supported while the folding lips 9 in the side leaves 8*c* of the first support platform 8 are pushed inwards by pushing the folding lips 5 provided in the side walls of the basic box 1 inwards from the outside of the basic box 1 (by a user), since the positions of the folding lips 5 correspond to the positions of the folding lips 9.

In the illustrated exemplary embodiment, the folding lips 9 in the side leaves 8*c* of the first support platform 8 are of a double design, because they each comprise a first folding lip 9*a*, the position of the fold line 9*b* of which, during use of the first support platform 8 in combination with the basic box 1, corresponds to the position of the fold line 5*a* of the respective folding lip 5 in the side wall 3*b* of the basic box 1, as a result of which both folding lips can be folded over in an identical manner when they are being pushed inwards from the outside. However, the fold length (distance between the fold line and the foldable, free end) of this first folding lip 9*a* is shorter than the fold length of the respective folding lip 5 in the side wall 3*b* of the basic box 1.

Each of the side leaves 8*c* of the first support platform 8 also comprises a second folding lip 9*c*, the position of the fold line 9*d* of which, during use of the first support platform 8 in combination with the basic box 1, is situated on the side of, but outside the reach of the free end of, the respective folding lip 5 in the side wall 3*b* of the basic box 1, while the position of the free end of the second folding lip 9*c* is inside the reach of the free end of the respective folding lip 5 in the side wall of the basic box 1, all this in such a way that when the respective folding lip 5 in the side wall 3*b* of the basic box 1 is pushed inwards, the free end of this folding lip 5 touches, and then passes, the free end of the respective second folding lip 9*c*, as a result of which the free end of the folding lip 5 in the side wall 3*b* of the basic box 1 is blocked by the second folding lip 9*c* in the side leaf 8*c* of the first support platform 8.

Figure 2:
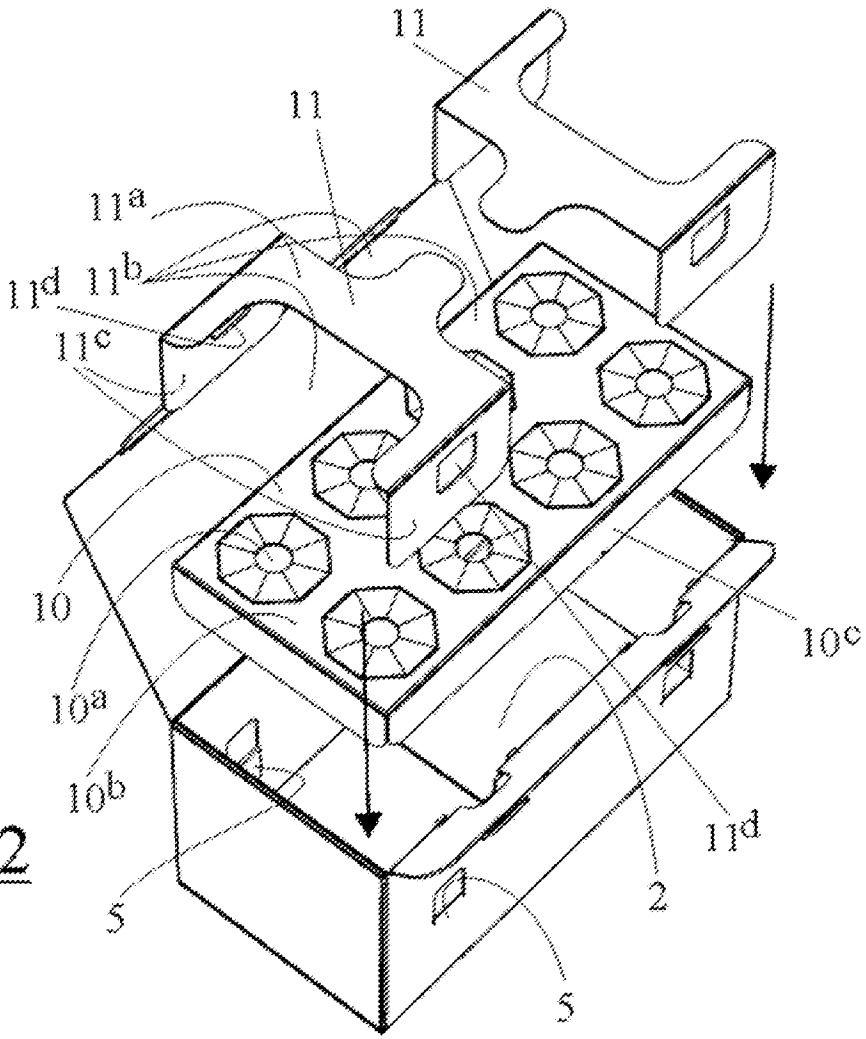
FIG. 2 shows the same exemplary embodiment as FIG. 1, but with the basic box being used in horizontal "chest mode"
Figure 2:
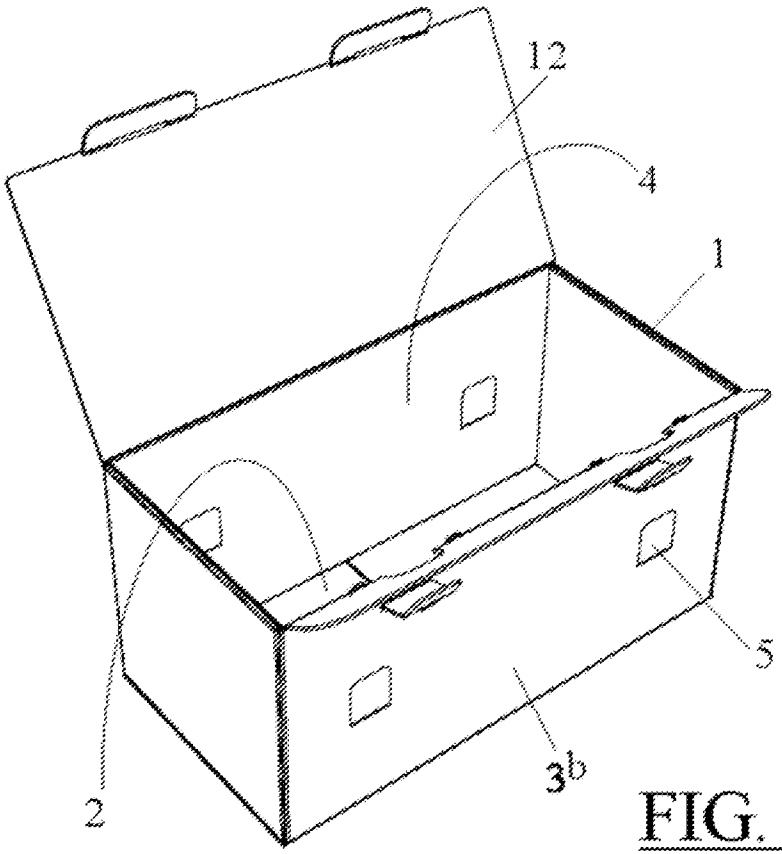

FIG. 2 shows the same exemplary embodiment as FIG. 1, but with the basic box being used in horizontal "chest mode".

For horizontal use of the basic box 1 for packaging potted plants in that position, the packaging box configuration comprises a second bearing platform 10 made of sheet material, preferably cardboard, comprising a carrier leaf 10*b* which is provided with pot openings 10*a*, and two oppositely positioned side leaves 10*c* which are configured to be folded down before the second bearing platform 10 is used in combination with the basic box 1. All this is configured in such a way that the carrier leaf 10*b* of the second bearing platform 10 extends inside the basic box 1 and is supported by its side leaves 10*c* on the fixed wall 2 serving as a bottom wall.

For horizontal use of the basic box 1 for packaging potted plants in that position, the packaging box configuration furthermore comprises, for example, two second support platforms 11 made of sheet material, preferably cardboard, comprising a support leaf 11*a* having one or more cavities or openings 11*b*, configured to lock and/or support the one or more plant pots and/or potted plants during use. The support platforms comprise at least two oppositely positioned side leaves 11*c* which are provided with locking openings 11*d* which are configured to be able to engage, behind or around the folding lips 5 which were pushed in beforehand and folded over towards the fixed wall 2, in the vertical side walls 3*b* of the basic box 1 in order to lock that second support platform 11.

All this is configured in such a manner that the carrier leaf 10*b* of the second bearing platform 10 extends inside the basic box and is supported by its side leaves 10*c* on the fixed wall 2 serving as a bottom wall, while the side leaves 11*c* of the second support platforms 11 are pushed between the side leaves 10*c* of the second bearing platform 10 and the (inside of the) side walls 3*b* of the basic box 1, wherein the locking openings 11*d* provided in the side leaves 11*c* of the respective second support platform 11 engage, around and/or behind the folding lips 5 which were pushed in beforehand and folded over towards the fixed wall 2, in the vertical side walls 3*b* of the basic box 1 ("click-fit") in order to lock that second support platform 11.

The open side 4 of the basic box 1 in addition comprises a lid or door 12 which is connected thereto so as to be foldable and configured to close off and thus protect the basic box 1 and its contents after either the first bearing platform 7, the first support platform 8 and the at least one potted plant, or the second bearing platform 10, the second support platform 11 and the one or more potted plants have been installed in the basic box 1 as its contents.

Figure 3:
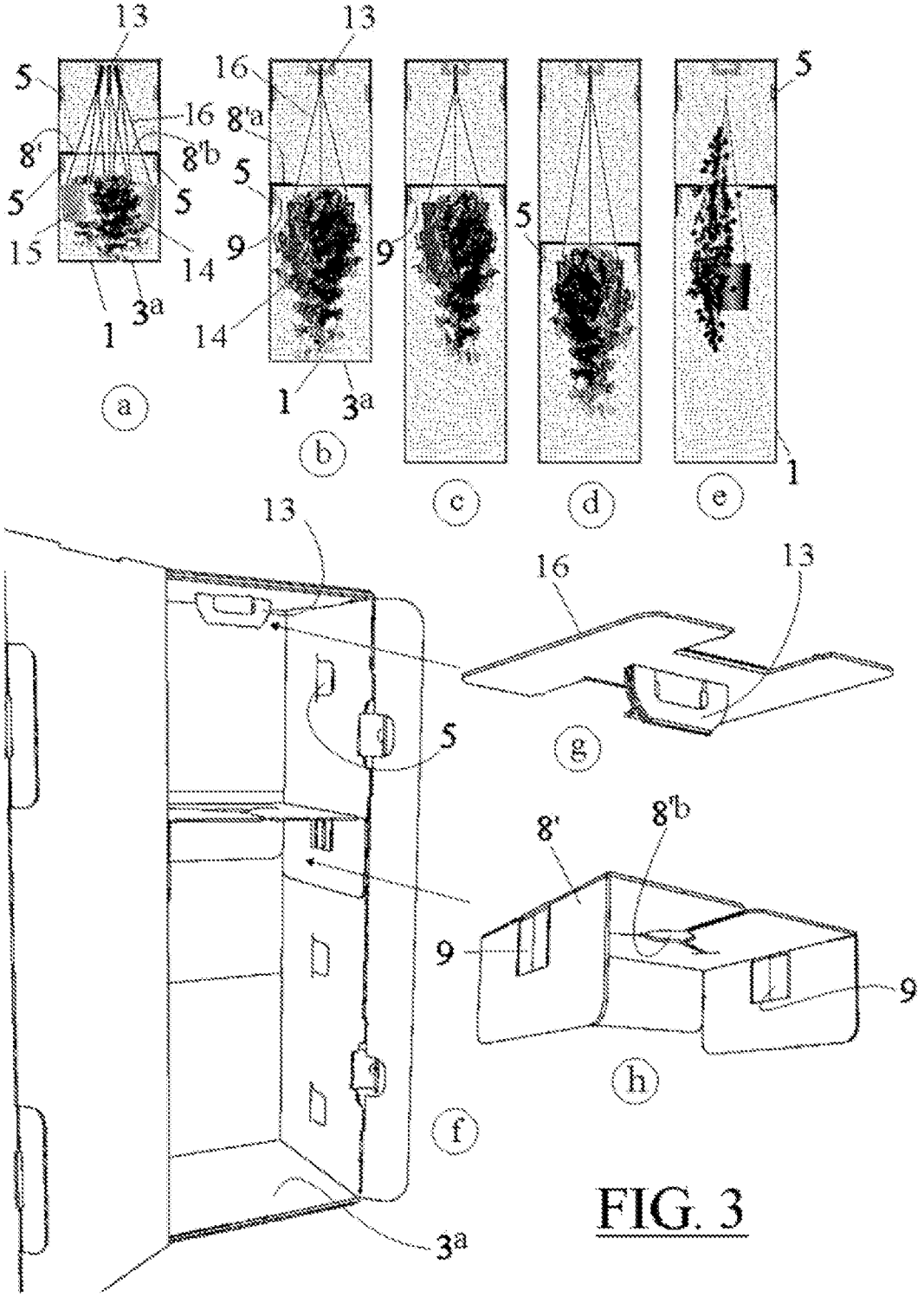
FIG. 3 shows another exemplary embodiment of the packaging box configuration according to the invention, in which the basic box is used in a vertical mode for packaging hanging plants.

FIG. 3 shows yet another exemplary embodiment of the packaging box configuration according to the invention, wherein the basic box is used in vertical mode for packaging hanging plants. In this case as well, like in the exemplary embodiment from FIG. 1, a support platform 8' is used in an upright box, approximately similar to the support platform 8 illustrated in FIG. 1, which is supported by the two folding lips 5 of the basic box 1 which can be pushed inwards from the outside to the inside. In this embodiment, the top side of the basic box 1 is provided with a suspension element 13 (for example by means of a fastening platform 16), from which one or more hanging plants 14 including pot 15 and bearing frame 16 can be suspended. In this case, the bearing frames 16 are suspended through an opening 8'*b* in the support leaf 8'*a* of the support platform 8', as a result of which the hanging plants can swing to and fro only to a very limited extent.

Thus, the present invention provides a packaging configuration for potted plants in which the same basic box can be used in either an upright, vertical position ("wardrobe mode") for packaging, for example, one relatively large potted plant, or in a horizontal position ("chest mode") for packaging, for example, several relatively small potted plants.

With regard to the Korean patent KR2020/0011287A, mentioned in the Dutch novelty report as D1, the following may be mentioned.

D1 also shows a packaging box configuration intended and configured for protectively packaging one or more potted plants, comprising a box made of sheet material, preferably cardboard, having a fixed bottom/rear wall, four side walls and an open side which can be closed off by a lid or door.

The box disclosed in D1 is provided with lug-shaped wall parts which can be pushed inwards in the corners (ribs) of the box, which serve to block a bearing platform for a plant pot against being displaced upwards.

In the configuration according to the invention, the side walls (3*a*, 3*b*) of the box (not in the corners/ribs, as is the case with the prior-art box) are provided with lips (5) which can be pushed inwards. When the box is being used in an upright position, see FIG. 1 and FIG. 3, these lips (5) in the walls serve (and are configured) to fix both a bearing platform (7) and a support platform (8) which is to be installed above the latter, with the position of these two platforms being locked by the same lips in the side walls (3*a*, 3*b*). The same lips also serve to fix another, similar bearing platform (10) and support platform (11) which are used when the plant box is used in a horizontal position, see FIG. 2.

The fixing lips (5) which are provided at various locations in the side walls allow multifunctional use of the plant box, as FIGS. 1, 2 and 3 illustrate, and this is not known or suggested in said prior art document and which not possible even when using the push-in lugs in the corners/ribs of the plant box.

As a result of the cooperation between said fixing lips (5) with blocking lips (9) in the support platforms which are described in more detail above, a configuration is obtained which is not only multifunctional, as has already been said, but in addition ensures, on the one hand, an improved connection between the plant box and the various platforms while, on the other hand, making it possible to remove these platforms quickly and easily by folding back the blocking lips (9) and fixing lips (5), following which the plant box and platforms can, if desired, be re-used again and may optionally be assembled to form another vertical or horizontal configuration.

In this way, a configuration is obtained which is new and inventive compared to said prior art and has more options for use and re-use and, in addition, is a more coherent and solid structure due to the use of the described fixing and blocking lips.

The invention claimed is:

1. A packaging box configuration for protectively packaging one or more potted plants, comprising:

a basic box (1) made of sheet material, having a fixed bottom or rear wall, referred to below as fixed wall (2), four side walls (3) and an open top or front side which is closable by a lid or door, referred to below as open side (4), which basic box is intended and configured to be able to be used either vertically, wherein one of the side walls (3*a*) then serves as a bottom wall and the fixed wall (2) as a rear wall, or horizontally, wherein the fixed wall (2) then serves as a bottom wall, wherein two mutually opposite side walls (3*b*) of the basic box are each provided with bottom folding lips (5) which can be pushed in from the outside to the inside along a fold line (5*a*) which extends parallel to the imaginary intersecting line (6) of a face of the two mutually opposite side walls and a face of the fixed wall;

wherein the vertical use of the basic box for packaging the potted plant comprises a first bearing platform (7) made of sheet material, comprising a carrier leaf (7*b*) provided with at least one pot opening (7*a*), and at least two oppositely positioned side leaves (7*c*) which are configured to be folded down before the first bearing platform is used in combination with the basic box; wherein all this is configured in such a way that the carrier leaf of the first bearing platform (7*b*) extends inside the basic box under the bottom folding lips (5) in the vertical side walls of the basic box, parallel to the side wall (3*a*) which, in this position of the basic box, serves as a bottom wall, a first support platform (8) made of sheet material, comprising a support leaf (8*a*) having one or more openings (8*b*), configured to lock or support the one or more plant pots or the potted plants during use, which support platform comprises at least two oppositely positioned side leaves (8*c*) which are provided with a folding lip (9) and which are configured to be folded down before the first support platform is used in combination with the basic box;

wherein all this is configured in such a way that the first support platform extends inside the basic box between the bottom folding lips (5) in the vertical side walls of the basic box, parallel to the side wall which, in this position of the basic box, serves as a bottom wall, while the folding lips (9) in the side leaves are positioned in such a way that the folding lips (9) in the side leaves of the first support platform are pushed inwards by pushing the bottom folding lips (5) provided in the side walls of the basic box inwards from the outside of the basic box.

2. The packaging box configuration according to claim 1, wherein the folding lips (9) in the side leaves of the first support platform are of a double design, because they comprise a first folding lip (9*a*), the position of the fold line (9*b*) of which, during use of the first support platform in combination with the basic box, corresponds to the position of the fold line (5*a*) of the bottom folding lips (5) in the side wall of the basic box and both folding lips (5, 9) fold inwards in the same manner when they are pushed in from the outside, a fold length of which first folding lip (9*a*) is nevertheless shorter than a fold length of the bottom folding lips (5) in the side wall of the basic box, wherein at least one of the side leaves of the first support platform comprises a second folding lip (9*c*), the fold line of which, during use of the first support platform in combination with the basic box, is situated on the side of, but outside the reach of, the free end of the bottom folding lips (5) in the side wall of the basic box, while the position of the free end of the second folding lip (9*c*) is inside the reach of the free end of the bottom folding lips (5) in the side wall of the basic box, all this in such a way that when the folding lips (9) in the side wall of the basic box is pushed inwards, the free end of the folding lips (9) touches, and then passes, the free end of the second folding lip (9*c*), as a result of which the free end of the bottom folding lips (5) in the side wall of the basic box is blocked by the second folding lip (9*c*) in the side leaf of the first support platform.

3. The packaging box configuration according to claim 1, comprising at least one lid or door (12) connected to a side of the open side of the basic box so as to be foldable, configured to close off and thus protect the basic box 1 and its contents after the first bearing platform, the first support platform and the at least one potted plant, have been installed in the basic box as contents.

4. A packaging box configuration for protectively packaging one or more potted plants, comprising:

a basic box (1) made of sheet material, having a fixed bottom or rear wall, referred to below as fixed wall (2), four side walls (3) and an open top or front side which is closable by a lid or door, referred to below as open side (4), which basic box is intended and configured to be able to be used either vertically, wherein one of the side walls (3*a*) then serves as a bottom wall and the fixed wall (2) as a rear wall, or horizontally, wherein the fixed wall (2) then serves as a bottom wall, wherein two mutually opposite side walls (3*b*) of the basic box are each provided with at least one folding lip (5) which can be pushed in from the outside to the inside along a fold line (5*a*) which extends parallel to the imaginary intersecting line (6) of a face of the two mutually opposite side walls and a face of the fixed wall;

wherein the horizontal use of the basic box for packaging the potted plants comprises a second bearing platform (10) made of sheet material, comprising a carrier leaf (10*b*) which is provided with one or more pot cavities (10*a*), and at least two oppositely positioned side leaves (10*c*) which are configured to be folded down before the second bearing platform is used in combination with the basic box, a second support platform (11) made of sheet material, comprising a support leaf (11*a*) having one or more openings (11*b*), configured to lock or support the one or more plant pots or the potted plants during use, which support platform comprises at least two oppositely positioned side leaves (11*c*) which are provided with one or more locking openings (11*d*) which are configured to engage, behind or around the folding lips (5) which were pushed in beforehand and folded over towards the fixed wall (2), in the vertical side walls of the basic box in order to lock the at least one second support platform; wherein all this is configured in such a manner that the carrier leaf of the second bearing platform extends inside the basic box and is supported by its side leaves on the fixed wall serving as a bottom wall, while the side leaves (11*c*) of the at least one second support platform are pushed between the side leaves (10*c*) of the second bearing platform and the side walls (3*b*) of the basic box, wherein the locking openings (11*d*) provided in the side leaves of the respective second support platform engage, around or behind the folding lips (5) which were pushed in beforehand and folded over towards the fixed wall, in the vertical side walls of the basic box in order to lock the at least one second support platform.

5. The packaging box configuration according to claim 4, comprising at least one lid or door (12) connected to a side of the open side of the basic box so as to be foldable, configured to close off and thus protect the basic box 1 and its contents after the second bearing platform, the second support platform and the one or more potted plants have been installed in the basic box as contents.

6. A packaging box configuration for protectively packaging one or more potted plants, comprising:

a basic box (1) made of sheet material, having a fixed bottom or rear wall, referred to below as fixed wall (2), four side walls (3) and an open top or front side which is closable by a lid or door, referred to below as open side (4), which basic box is intended and configured to be able to be used either vertically, wherein one of the side walls (3*a*) then serves as a bottom wall and the fixed wall (2) as a rear wall, or horizontally, wherein the fixed wall (2) then serves as a bottom wall, wherein two mutually opposite side walls (3*b*) of the basic box are each provided with at least one folding lip (5) which can be pushed in from the outside to the inside along a fold line (5*a*) which extends parallel to the imaginary intersecting line (6) of a face of the two mutually opposite side walls and a face of the fixed wall;

wherein the vertical use of the basic box for packaging the potted plant comprises a suspension means (13) configured for suspending one or more hanging plants (14) including pot (15) and bearing frame (16) therefrom, a third support platform (8') of sheet material, comprising a support leaf (8'*a*) having one or more openings (8'*b*), configured to lock or support the one or more hanging plants or plant pots or bearing frames during use, which support platform comprises at least two oppositely positioned side leaves which are provided with a folding lip and which are configured to be folded downwards or upwards before the first support platform is used in combination with the basic box;

wherein all this is configured in such a way that the third support platform extends inside the basic box between oppositely positioned folding lips (5) in the vertical side walls of the basic box, parallel to the side wall (3*a*) which, in this position of the basic box serves as a bottom wall, while the folding lips in the side leaves are positioned in such a way that the folding lips (9) in the side leaves of the support platform are pushed inwards by pushing the folding lips (5) provided in the side walls of the basic box inwards from the outside of the basic box.

* * * * *